US005638564A

United States Patent [19]

Greenawalt et al.

[11] Patent Number: 5,638,564

[45] Date of Patent: Jun. 17, 1997

[54] THERAPEUTIC PILLOW

[75] Inventors: Kent S. Greenawalt; Dwayne H. Bennett, both of Roanoke, Va.

[73] Assignee: Foot Levelers, Inc., Roanoke, Va.

[21] Appl. No.: 552,096

[22] Filed: Nov. 2, 1995

[51] Int. Cl.[6] ..... A47C 20/00; A47G 9/00

[52] U.S. Cl. ..... 5/636; 5/655.9

[58] Field of Search ..... 5/464, 481, 636, 5/643, 645

[56] References Cited

U.S. PATENT DOCUMENTS

| | | | |
|---|---|---|---|
| 655,087 | 7/1900 | Jones . | |
| 1,020,444 | 3/1912 | Platt . | |
| 2,880,428 | 4/1959 | Forsland . | |
| 3,261,035 | 7/1966 | Slocum . | |
| 3,388,408 | 6/1968 | Blaney . | |
| 3,521,310 | 7/1970 | Greenawalt . | |
| 3,648,308 | 3/1972 | Greenawalt . | |
| 4,424,599 | 1/1984 | Hannouche . | |
| 4,432,107 | 2/1984 | Clark et al. . | |
| 4,494,261 | 1/1985 | Morrow . | |
| 4,670,925 | 6/1987 | Carussi | 5/481 |
| 4,726,086 | 2/1988 | McEvoy | 5/464 |
| 4,803,743 | 2/1989 | Greenawalt . | |

FOREIGN PATENT DOCUMENTS

| | | | |
|---|---|---|---|
| 898256 | 6/1962 | United Kingdom . | |
| 2016918 | 9/1979 | United Kingdom | 5/464 |

*Primary Examiner*—Rodney M. Lindsey
*Assistant Examiner*—Robert G. Santos
*Attorney, Agent, or Firm*—Henderson & Sturm

[57] ABSTRACT

A therapeutic pillow for supporting the head and neck of a person lying in a supine position. The pillow comprises three types of material, each having differing degrees of firmness; a first material having in cross-section a U-shaped form with one end wider than the other end, a second material having a separated pair of end portions of equal width, respectively, with the first material end portions and secured thereto, respectively to form curved ends of the pillow and the third material having a rectangular shape of a size to fit into the open center portion formed by the first and second materials.

5 Claims, 1 Drawing Sheet

THERAPEUTIC PILLOW

TECHNICAL FIELD

This invention relates generally to pillows, and more particularly to a combination head and neck pillow designed to be placed under the head and neck of a person lying in a supine position.

BACKGROUND ART

This invention relates to pillow construction, and more particularly to pillows which aid in relieving stress in the cervical or neck portion of the upper spine, and for promoting proper posture. Since approximately one-third of all human existence is spent in a supine position, innovators in posture or cervical pillows have long continued to develop new designs of this type of pillow which will support the head and spine, and the neck vertebrae in particular in the most normal, comfortable and unstressed position.

Prior art efforts at achieving such a pillow have shown the use of a combination of firma and soft portions of a pillow in varied arrangements, but which have either resulted in a flattening of the spinal column, or in exaggerating the curvature thereof. Furthermore, such prior art efforts do not provide the variety of therapeutic uses of the same pillow for different age and frame groups.

Still further, even with advancements as described in U.S. Pat. No. 4,803,743 issued Feb. 14, 1989, it is found that certain patients are taking too long to become accustomed to a new sleeping posture and thus may abandon previous advancements to the detriment of their health and well-being.

DISCLOSURE OF THE INVENTION

This invention provides a therapeutic pillow the construction of which enables it to be used over a period of years by youngsters and small flamed adults for the treatment of conditions such as: improper cervical spine alignment, whiplash, cervical strains and sprains, tension headaches, and neck or shoulder problems.

The pillow of this invention provides effectively four different support positions for the head, neck and shoulders of a person, whether lying supine or on the side. A first position provides a wide medium firm edge of the pillow with a soft center. A second position provides a narrow medium firm edge with a soft center. Upon reversing or flipping the pillow over, a third position provides a wide firm edge with a medium center; and a fourth position of the pillow provides a narrow firm edge with a medium center.

These positions are provided by a pair of pillows bonded together to form one. The first pillow member has one side or edge wider than the other side or edge; with the bottom surface for example, planar and with an irregular depression formed in the upper or opposite surface. The wide edge and the narrow edge each has two half portions, one of the same firmness as the planar portion, the other portion being less firm, but more firm than the second pillow member. The second pillow member is of a different resistance to depression, being somewhat softer than the first pillow member, and is adapted to fit snugly into the depression such that the resulting upper surface of the combined pillow members is not greatly unlike the bottom surface of the first pillow member.

Further, the pillow of this invention adds the features and advantages of the first pillow member one side or edge and the opposite side or edge each having an upper half portion of a firmness less than that of the remaining lower half portion of each side or edge, but of a firmness still more than that of the second pillow member. Thus, by reducing the firmness of one set of half edges, both on the same side, upper or lower, of the pillow for this invention, the patient may adapt more comfortably to the new sleeping posture.

Thus, a new and improved therapeutic pillow is shown herein for shortening the break-in time for use of the pillow, also making that time period more convenient and comfortable and ensuring better patient compliance and results.

These and other objects, features and advantages of the present invention will be apparent from the following description, appended claims and annexed drawings.

BRIEF DESCRIPTION OF THE DRAWINGS

The invention will be better understood and objects other than those set forth above will become apparent when consideration is given to the following detailed description thereof. Such description means reference to the annexed drawings wherein.

BEST MODE FOR CARRYING OUT THE INVENTION

Figure 1:
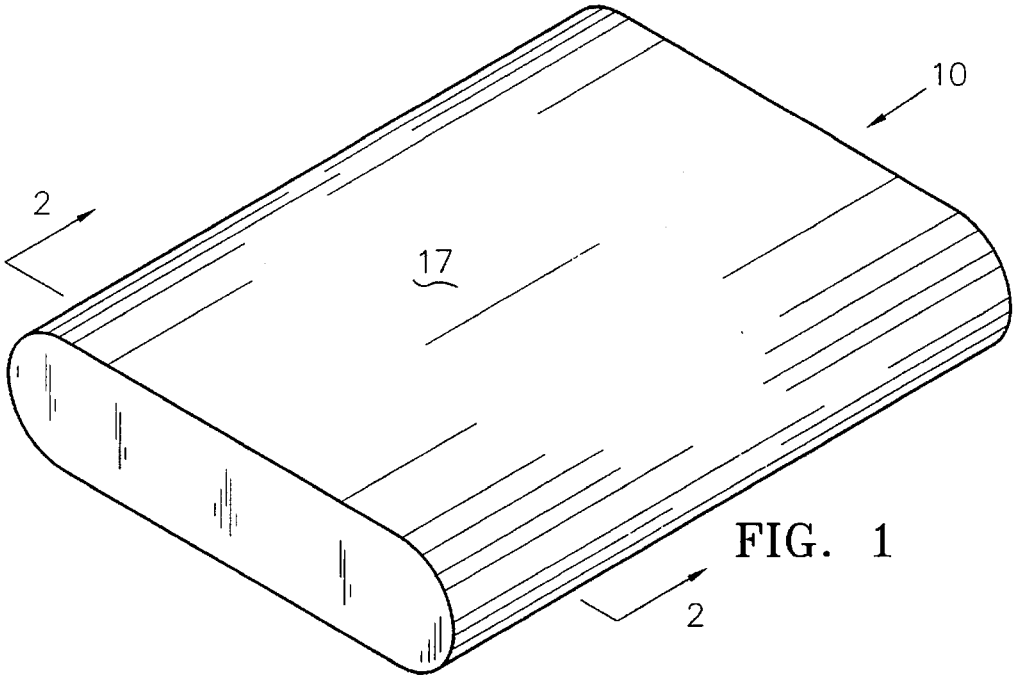
FIG. 1 is a perspective view of the therapeutic pillow of this invention.

The pillow of this invention capable of attaining the objects described hereinbefore is generally indicated by the numeral (10) in FIG. 1. Generally, the therapeutic pillow (10) comprises a firm, first member (11) (FIGS. 2 and 3), a less firm or sorer second member (12) having laterally separated first and second edge portions (13), (14), respectively, and an even more sorer third member (16); with an outer ticking (17) covering the combined members (11), (12) and (13).

Figure 2:
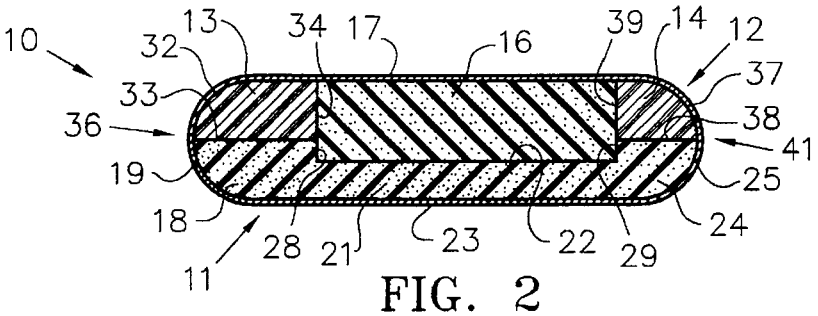
FIG. 2 is a cross-sectional view taken along the line 2—2 in FIG. 1.
Figure 3:
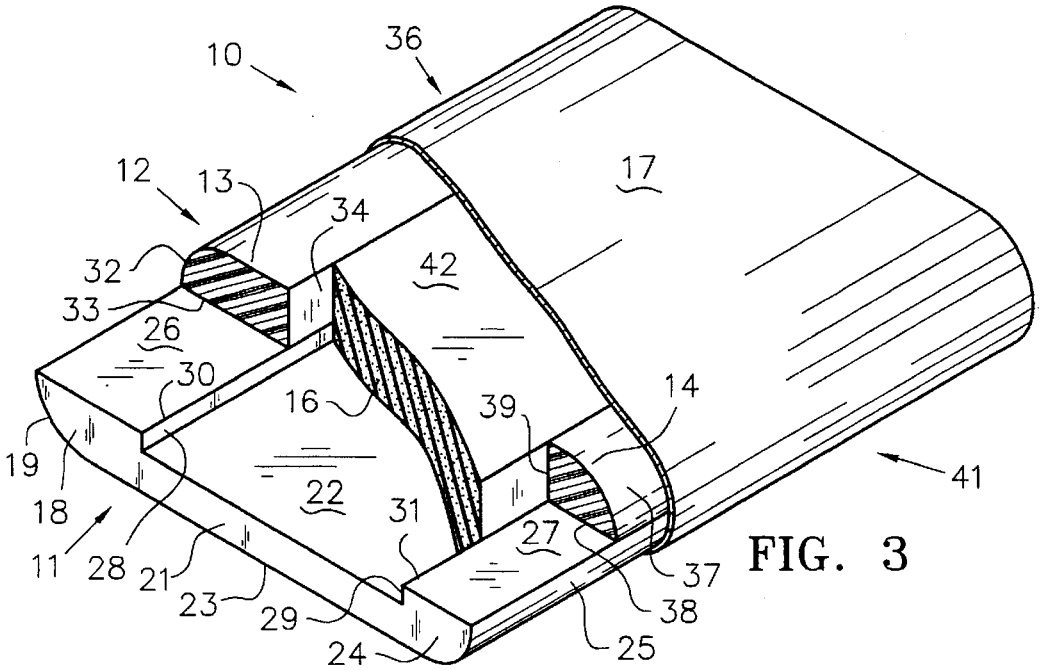
FIG. 3 is a view similar to FIG. 1, but with a cover partially removed and certain portions of varying firmness shown in sections.

More particularly, and referring to FIGS. 2 and 3, the first member (11) is comprised, in cross section, with a wide side (18) having an outer rounded edge (19), an intermediate portion (21) of a thickness less than that of the wide side (18), the intermediate portion (21) having relatively flat or planar top and bottom surfaces (22), (23), respectively; and a narrow side (24) having the same height or thickness as the wide side (18), but a width less than that of the wide side (18).

The narrow side (24) has a rounded edge (25) similar to the rounded edge (19) of the wide side (18). Both the wide side (18) and the narrow side (24) have substantially planar top surfaces (26), (27), respectively. As the thickness of the intermediate portion (21) is less than the side portions (18) and (24), a pair of substantially vertical shoulders (28), (29) (FIG. 3) are formed, which shoulders (28), (29) form corners (30), (31) with the inner ends of the top surfaces (22), (26) of the sides (18) and (24), respectively.

The first edge portion (13) of the second member (12) (FIG. 2) has a thickness and a width equal to that of the wide side (18), and is provided with a rounded edge (32), a bottom planar surface (33) and an inner substantially vertical surface (34). With the respective top surface (26) of the wide side (18), and the bottom surface (33) of the first edge portion (13) bonded together, the respective rounded edges (19) and (32) form a rounded end (36) of the pillow (10) as is best shown in FIG. 2.

The second edge portion (14) of the second member (12) also has a rounded edge (37), with a bottom planar surface (38) and an inner substantially vertical surface (39). With the respective top surface (27) of the narrow side (24), and the bottom surface (38) of the second edge portion (37) bonded together, again the rounded edges (25) and (37) join to form another rounded end (41) of the pillow (10), the end (41) being opposite the end (36) as is best shown in FIG. 2. It should further be noted, referring to FIG. 2, that the bonded surfaces (26), (33) on the left side of the pillow (10), and the bonded surfaces (27) and (38) on the fight side thereof are disposed in a common horizontal plane running through the pillow (10), which plane is disposed at substantially half of the vertical thickness of the pillow (10). It should also be noted that the widths of the combined wide side (18) and the first edge portion (13) are equal, as are the widths of the combined narrow side (24) and second edge portion (14), as best illustrated in FIG. 2; it being noted also that the width of the combined wide side (18) and first edge portion (14) is greater than the width of the combined narrow side (24) and second edge portion (14).

Referring to FIGS. 2 and 3, it will be noted that by the previously described bonded relationships of the first member (11) and the second member edge portions (13), (14), a substantially, rectangularly formed cavity is provided as defined by substantially vertical shoulders (34), (28) on the left side as viewed in FIG. 2, and substantially vertically disposed shoulders (39) and (29) on the right side of the cavity as viewed in FIG. 2, with the floor of the cavity comprising the planar top surface (22) of the intermediate portion (21 ). The third member (16), having a softness more than the first and second edge portions (13) and (14), and even more than the first member (11), and having a rectangular shape sized to fit closely, so as to be bonded to the sides and bottom of the cavity, is disposed within the cavity as best illustrated in FIGS. 2 and 3. As the height of the third member (16) is the same as the height of the combined shoulders (34), (28) on the left side of the cavity (FIG. 2), and is the same as the combined height of the shoulders (39), (29) on the right side of the cavity (FIG. 2), and as the upper surface (42) of the third member (16) is relatively flat or planar, it will be noted that the complete top surface of the pillow (10) is relatively flat, except for the rounding of the opposed ends (36), (41), as noted hereinbefore.

The first pillow member (11) is comprised of a polyurethane cellular foam plastic, the second member (12) with its first and second edge portions (13), (14) is comprised of an ergonomic urethane, and the third member (16) is comprised of a polyester fiber. Again, the first member (11) is the most firm of the three members, the second member (12) being less firm than the first member (11), and the third member (16) being even less firm than the second member (12). By this arrangement, it will be understood that various therapeutic uses of this pillow (10) are available.

For example, for one to use the pillow in the position shown in FIG. 2, the neck of a person could be placed as desired on either the wider first edge portion (13) or, alternatively, on the more narrow second edge portion (14). The head would rest on the softest part of the pillow, the third member (16).

Were the pillow (10) to be turned over, such that the upper surface (42) of the third member (16) be on the bottom of the pillow (10), then the patient has the alternative of placing his/her neck on either the wider side (18) of the first member (11), or on the more narrow side (24) of the member (11). The use is even more varied in that, as has been noted hereinbefore, the softness of the sides (18) and (24) is less than the softness of the edge portions (13), (14). Further, in the reversed position as just described, the head of the patient, rather than being placed on the softest third member, would now be placed on the more firm intermediate portion (21) of the first member (11).

Should the prescription be that the patient utilize, for the desired therapy, the more firm sides (18) and (24) of the first member (11), but should the patient find it somewhat uncomfortable to initially use the pillow in that position, then by reversing the position of the pillow such that it is in the position shown in FIG. 2, the patient could initially place his/her neck on the softer, upper portions (13) and (14) of the second member (12). The patient could then, at his/her convenience and comfort level, work up to the utilization of the neck being placed on the more firm sides (18) and (24) as was originally desired by the person prescribing use of the pillow (10).

It is thus seen that the objects and advantages of the invention as described and defined hereinbefore have been achieved.

We claim:

1. A therapeutic pillow for supporting the head and neck of a person lying in a supine or side position, comprising:

a first member having a U-shape with a first side of a predetermined height and width, a second opposite side of a height equal that of said first side and a width less than the width of said first side, and a portion intermediate said first and second sides, said intermediate portion having a height less than the height of said first and second sides, said first and second sides and said intermediate portion having substantially planar upper surfaces;

a second member comprised of a pair of separate edge portions, a first edge portion having a height and width equal that of said first side, and with a lower surface bonded to the upper surface of said first side, a second edge portion having a height and width equal that of said second side, and with a lower surface bonded to the upper surface of said second side, said first and second members as bonded forming a substantially rectangular cavity above said intermediate portion planar surface; and a third member having a substantially rectangular shape, said third member bonded to said first and second members within said cavity;

said first member having a predetermined firmness, said second member having a firmness less than said first member, and said third member having a firmness less than said second member.

2. The therapeutic pillow of claim 1, and further wherein said first side and said first edge portion have first inner co-planar vertical surfaces, and said second side and said second edge portion have second inner co-planar vertical surfaces opposite said first surfaces.

3. The therapeutic pillow of claim 2, and further wherein said first edge portion, said third member and said second edge portion have substantially co-planar upper surfaces.

4. The therapeutic pillow of claim 3, and further wherein said first side and said first edge portion form a convexly-curved outer surface at one side of the pillow, and said second side and said second edge portion form a convexly curved outer surface at an opposite side of the pillow, and said pillow having substantially flat top and bottom surfaces disposed in parallel planes.

5. The therapeutic pillow of claim 4, and further wherein said planar upper surfacing of said first and second sides are co-planar and are disposed one-half the full height of the pillow.

* * * * *